US006331838B1

(12) United States Patent
Scott et al.

(10) Patent No.: US 6,331,838 B1
(45) Date of Patent: Dec. 18, 2001

(54) FLEXIBLE VEHICLE ANTENNA

(75) Inventors: Stephen Daniel Scott, Fenton; Daniel Gordon Morris, Ovid, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/619,244

(22) Filed: Jul. 19, 2000

(51) Int. Cl.[7] ..... H01Q 1/32
(52) U.S. Cl. ..... 343/715; 343/895
(58) Field of Search ..... 343/895, 713, 343/715, 900, 903; H01Q 1/32

(56) References Cited

U.S. PATENT DOCUMENTS

| | | | |
|---|---|---|---|
| 4,163,981 | 8/1979 | Wilson | 343/715 |
| 4,266,227 | 5/1981 | Blaese | 343/715 |
| 4,323,902 | 4/1982 | Hussey et al. | 343/903 |
| 4,393,383 | 7/1983 | Yamashita | 343/903 |
| 5,198,831 | 3/1993 | Burrell et al. | 343/895 |
| 5,451,967 * | 9/1995 | Ueda et al. | 343/715 |
| 5,528,314 | 6/1996 | Nagy et al. | 343/713 |
| 5,610,619 | 3/1997 | Zafar | 343/713 |
| 5,648,785 | 7/1997 | Nagy et al. | 343/713 |
| 5,668,565 | 9/1997 | Robinson | 343/895 |
| 5,714,959 | 2/1998 | Troy et al. | 343/713 |
| 5,739,794 | 4/1998 | Nagy et al. | 343/713 |
| 5,790,079 | 8/1998 | Zafar | 343/713 |
| 5,986,612 | 11/1999 | Nagy | 343/713 |

* cited by examiner

*Primary Examiner*—Michael C. Wimer
(74) *Attorney, Agent, or Firm*—Jimmy L. Funke

(57) ABSTRACT

An antenna adapted to be mounted to a motor vehicle for receiving digital audio signals from a satellite. The antenna includes a base configured to be secured to a vehicle, and an elongated mast constructed of a polymer material and including at least one antenna-forming conductor extending along the mast to receive signals. A spring member flexibly connects the elongated mast to the base, and an elastomeric cover extends between the base and the elongated mast and envelops the spring member. A flexible conductor is connected to the antenna-forming conductor and extends through the elastomeric cover.

22 Claims, 4 Drawing Sheets

FLEXIBLE VEHICLE ANTENNA

TECHNICAL FIELD

The present invention relates to an antenna that is suitable for mounting on a mobile vehicle, such as an automobile, truck, or other motor vehicle.

BACKGROUND OF THE INVENTION

Various antennas for mounting to motor vehicles have been developed. For example, "whip-type" antennas having a flexible fiberglass or Teflon rod with a helically-wound conductor for receiving radio signals have been developed. Mobile vehicle antennas often employ a flexible mounting base to allow for impact with an object. For example, U.S. Pat. No. 4,393,383 to Yamashita discloses a spring-mounted antenna including a coaxial cable and a flexible body portion surrounding the coaxial cable. Also, global positioning satellite (GPS) navigators having quadrifilar helical antennas have been developed. For example, U.S. Pat. No. 5,198,831 discloses a GPS navigator that may be vehicle mounted, and includes a tubular, quadrifilar antenna structure. Further, various window mounted or film type antennas for vehicles have been developed. Examples of such antennas are disclosed in U.S. Pat. Nos. 5,739,794; 5,714,959; 5,648,785; 5,610,619; and 5,528,314.

SUMMARY OF THE INVENTION

One aspect of the present invention is an antenna adapted to be mounted to a motor vehicle for receiving digital audio signals from a satellite. The antenna includes a base configured to be secured to a vehicle, and an elongated mast constructed of a polymer material and including at least one antenna-forming conductor extending along the mast to receive signals. A spring member flexibly connects the elongated mast to the base, and an elastomeric cover extends between the base and the elongated mast and envelops the spring member. A flexible conductor is connected to the antenna-forming conductor and extends through the elastomeric cover.

Another aspect of the present invention is an antenna for receiving digital signals from a satellite. The antenna includes a base configured to be secured to a motor vehicle. An elongated mast constructed of a dielectric material has a generally cylindrical outer surface, and defines a base end. Four elongated antenna conductors are disposed on the outer surface of the elongated mast and form a quadrifilar helical antenna. Each antenna conductors has an electrical feed point adjacent the base end of the elongated mast. The feed points are progressively phased by about ninety degrees relative to one another. A flexible member connects the elongated mast to the base and biases the mast into a use position. The antenna further includes a flexible elongated conductor and a phase network positioned adjacent the base end of the mast and electrically connecting the electrical feed points of the elongated antenna conductors to the flexible cable.

Yet another aspect of the present invention is an antenna for mounting on a motor vehicle for receiving digital signals from a satellite. The antenna includes a base having an electronics case with a cavity adapted to receive electronic components therein. The electronics case has an inner shell made of a rigid material forming the cavity, and an outer cover of an elastomeric material enveloping the inner shell and forming a gasket configured to seal the cavity when the electronics case is mounted to a vehicle. An elongated mast is secured to the base, and at least one elongated antenna conductor extends along the mast to receive signals.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which:

FIG. 1.

DESCRIPTION OF THE PREFERRED EMBODIMENTS

Figure 1:
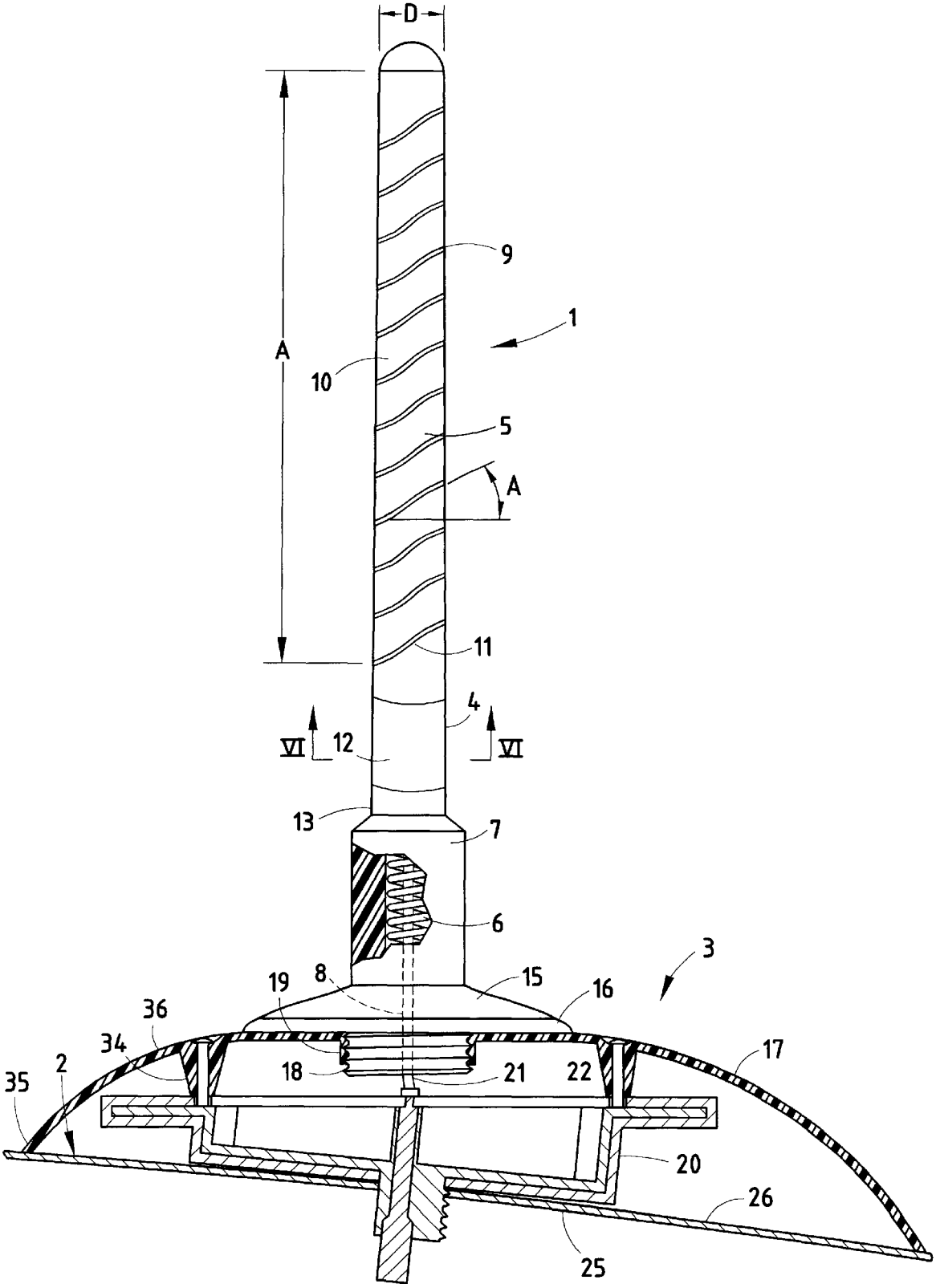
FIG. 1 is a front elevational view of an antenna according to the present invention.
Figure 2:
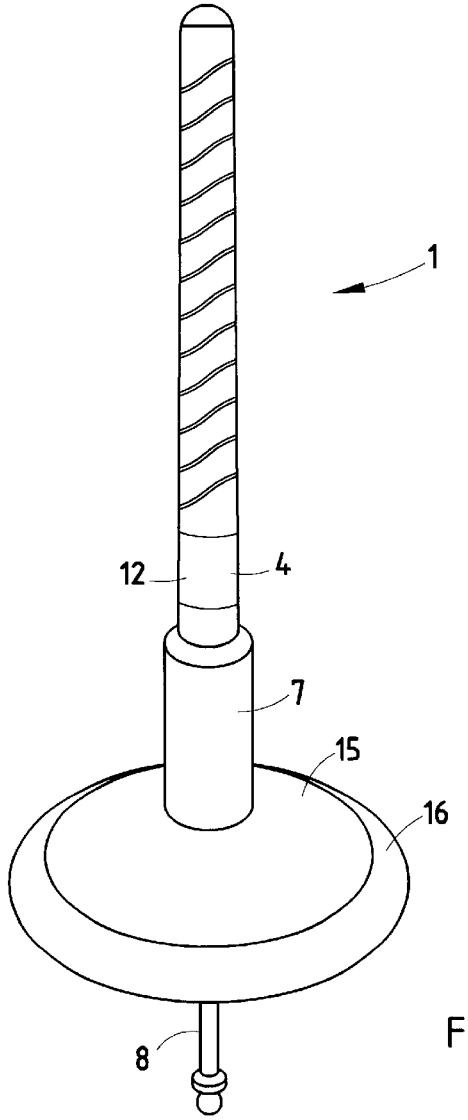
FIG. 2 is a perspective view of the antenna of FIG. 1.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, an antenna 1 is illustrated according to the present invention. Antenna 1 is adapted to be mounted to a motor vehicle 2 for receiving digital audio signals from one or more remote transmitters, such as a satellite or land-based transmitters. Antenna 1 includes a base 3 configured to be secured to the vehicle 2. An elongated mast 4 is constructed of a polymer material, and includes at least one antenna-forming conductor 5 extending along the mast to receive signals. A flexible member, such as a coil spring 6 flexibly connects the elongated mast 4 to the base 3, and an elastomeric cover 7 extends between the base 3 and the elongated mast 4 and envelops the coil spring 6. A flexible conductor such as coaxial cable 8 is connected to the antenna-forming conductor 5, and extends through the coil spring 6 and elastomeric cover 7.

Mast 4 is molded from a polymer material, such as VALOX® thermoplastic resin, available from General Electric Company, and has a generally tubular construction. A MYLAR® film 9 includes four copper traces forming four conductors 5 to form a quadrifilar antenna element 10 that is positioned within the tubular mast 4 (see also FIG. 6). The substrate/film 9 with copper traces 5 is wrapped around and bonded to the mast 4 with traces 5 forming a spiral around mast 4. Each trace extends at angle "A" of about 65 degrees in a preferred embodiment. According to one example, mast 4 has a diameter of 9.5 mm, and the quadrifilar antenna element 10 has an overall length A of 120.7mm. The four conductors 5 form four electrical feed points 11. A phase network 12 is electrically connected to the feed points 11, and combines the four feed points into one antenna input that is connected to the coaxial cable 8. As described in more detail below, phase network 12 is formed on the substrate film 9 in the same manner as traces 5. The phase network 12 could be a microstrip phase circuit, a discrete hybrid coupler network, or other phase network. The phase network 12 is soldered or otherwise electrically connected to the coaxial cable 8, thereby allowing connection to the electronics in the case 20.

Coil spring 6 is secured to the lower end 13 of mast 4, and flexibly mounts the antenna to the mounting member 15. Mounting member 15, like mast 4, is also preferably made of a VALOX® polymer material. Coaxial cable 8 extends through coil spring 6, and elastomeric cover 7 is molded over the spring 6 to provide flexibility to allow the mast 4 to deflect in the event of impact with a foreign object. Cover 7 is preferably made of a SANTOPRENE® thermoplastic elastomer, or other suitable flexible material. An elastomeric seal 16 may extend around mounting member 15 to provide a seal against a cover 17. Cover 17 includes a threaded opening that receives threaded end 18 of mounting member 15. Coaxial cable 8 is connected to the phase network 12, and extends through the coil spring 6, and mounting member 15. An SMB or other RF connector connects to a circuit board 22 in electronics case 20.

Figure 3:
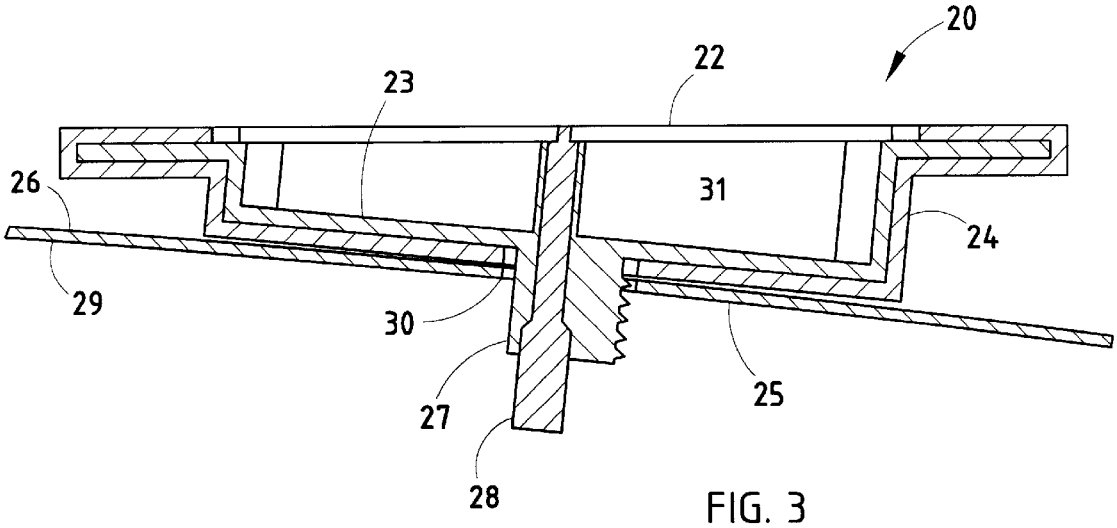
FIG. 3 is a cross-sectional view of the electronics case of FIG. 1.
Figure 4:
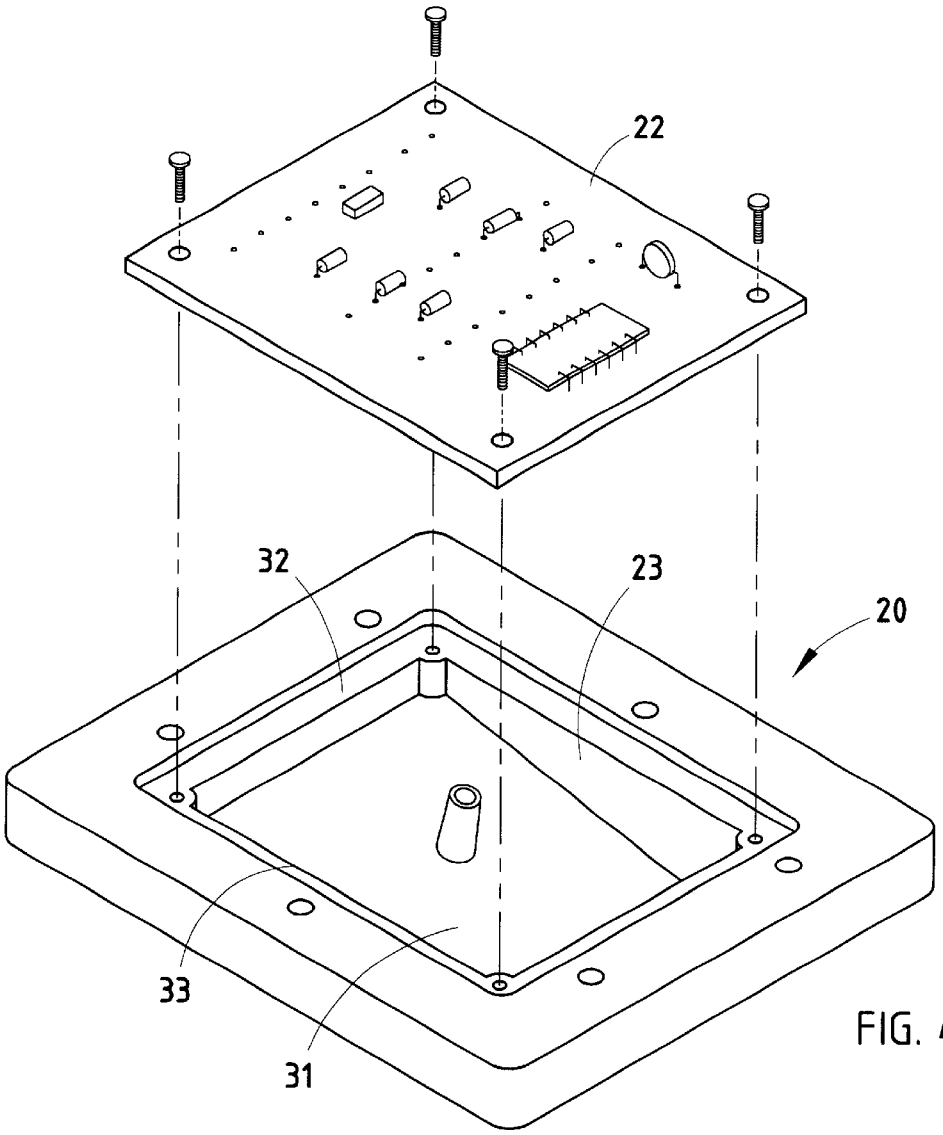
FIG. 4 is an exploded perspective view of the electronics case of FIG. 3.

With further reference to FIGS. 3 and 4, electronics case 20 includes a hard inner shell 23 formed of a zinc diecast or other suitable material. The conductive shell 23 ensures that the antenna components are shielded from feedback. An elastomeric outer shell 24 extends over the hard inner shell 23, and forms a gasket surface 25 that seals against an outer surface 26 of a motor vehicle 2. An extension 27 of inner shell 23 extends downwardly through an opening 30 in the outer layer 29 of motor vehicle 2, and a second SMB connector 28 extends through the extension 27, and connects to the circuit board 22. Electronics case 20 forms a cavity 31 for receiving electronics components, including circuit board 22. A recessed edge 32 extends around the perimeter 33 of cavity 31, and circuit board 22 rests on edge 32 when installed. A plurality of fasteners or other suitable fasteners 34 or other suitable connectors are utilized to secure cover 17 to the electronics case 20. Cover 17 has a smooth, shallow dome-like shape, with a perimeter 35 that fits closely against the surface 26 of the vehicle 2 to provide a smooth, unobtrusive appearance. Cover 17 may be designed to conform to the surface shape of various vehicles, such that antenna 1 can be readily mounted to the roof or other location on a variety of vehicles by utilizing a cover 17 conforming to the surface contour of a particular vehicle.

Figure 5:
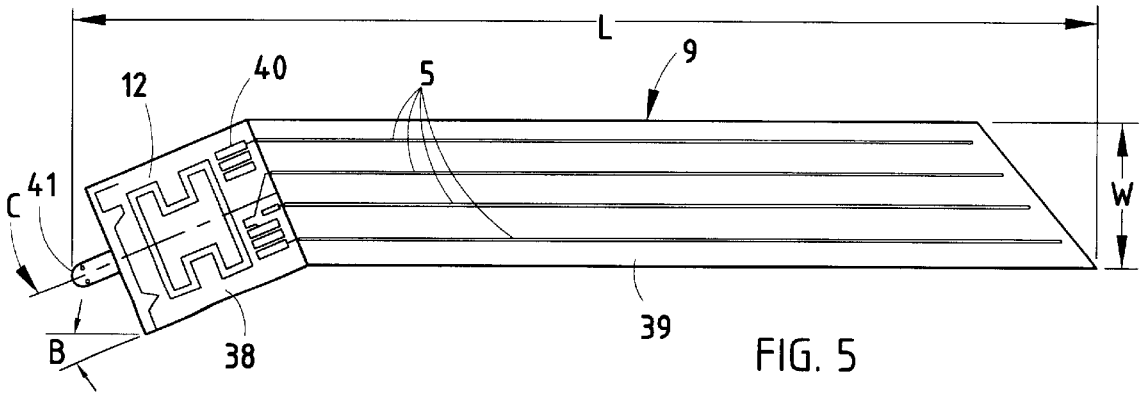
FIG. 5 is a plan view of the flexible substrate, antenna element, and phase circuit of FIG. 1.

With reference to FIG. 5, copper antenna traces 5 and the phase network 12 are formed on a thin flexible substrate 9. The overall length "L" of the substrate 9 is 251.3 mm, and the antenna section 39 of the substrate 9 has a width "W" of 27.3 mm. The rectangular circuit portion 38 of the substrate 9 forms a centerline "C" that extends at an angle "B" of 25 degrees relative to the antenna traces 5. When assembled, centerline C extends parallel to the centerline of mast 4. In a preferred embodiment, traces 5 have a width of 2.5 mm, and the substrate is Mylar, Kapton or other flexible material. The phase network 12 includes a plurality of delay lines 40 that provide input for the coaxial cable 8. Such phase networks are generally known, and an example is illustrated in U.S. Pat. No. 5,198,831 entitled "Personal Positioning Satellite Navigator With Printed Quadrifilar Helical Antenna" to Burrell et al. Although the Burrell '831 phase circuit has a generally similar construction, the phase circuit 12 of the present invention is designed to process satellite signals in the 2.3–2.4 GHz range. The phase network 12 feeds into a tab-like connector 41 that is configured to connect to a R6316 cable. When assembled, connector 41 extends into the cavity 43 (FIG. 6) of mast 4. During assembly, the elongated portion 39 of substrate/film 9 with traces 5 is rolled to form a tube. The tubular mast 4 is then molded over the tubular film 9. Because the circuit board 22 and related electronics are remote from the mast 4, mast 4 can be constructed with a relatively small outer diameter, thus providing a compact antenna suitable for use with automobiles, trucks, and the like.

Figures 6, 7:
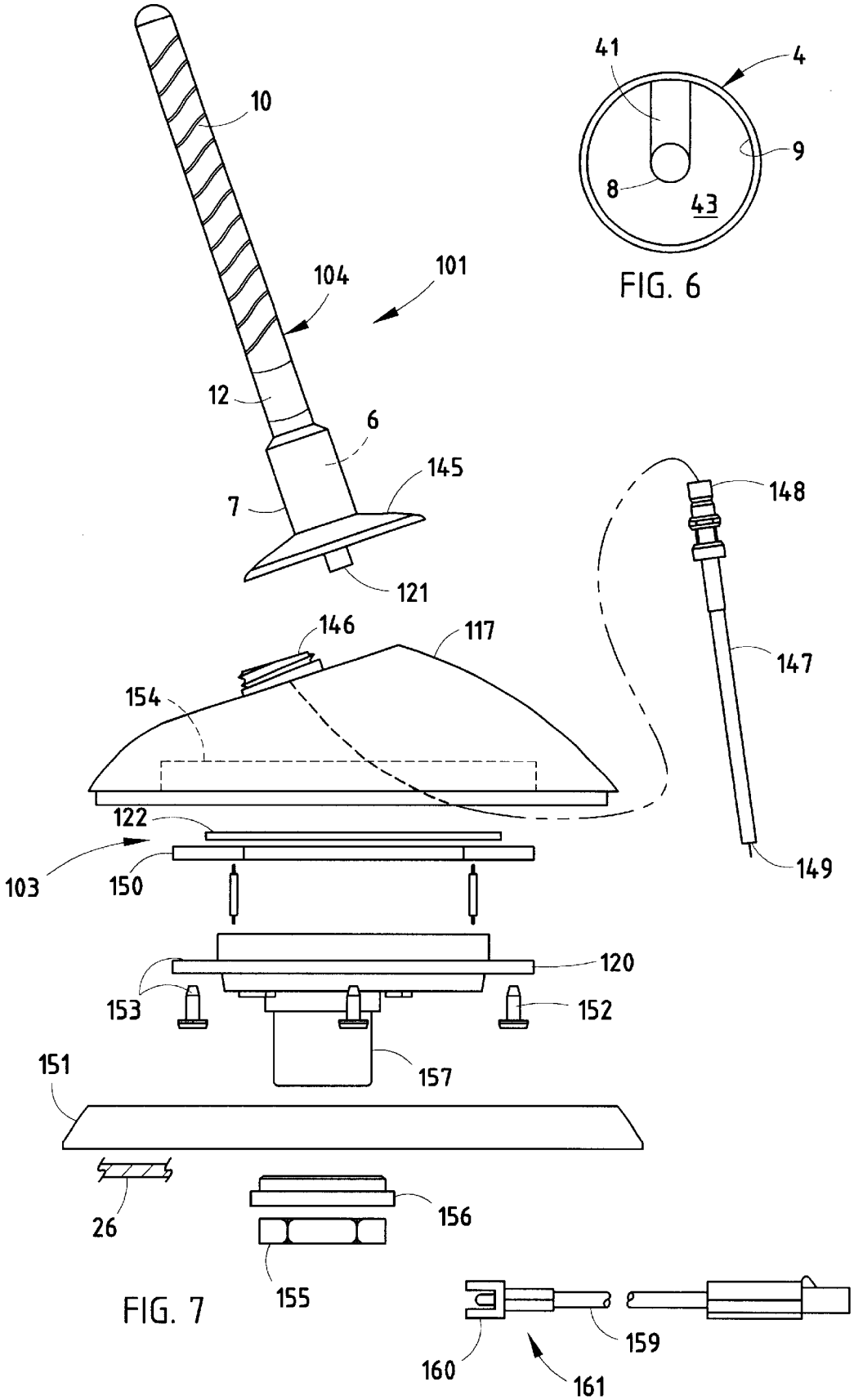
FIG. 6 is a cross-sectional view of the antenna taken along the line VI—VI.
FIG. 7 is an exploded view of a second embodiment of the antenna.

A second embodiment 101 of the antenna is illustrated in FIG. 7. Antenna assembly 101 is similar to antenna 1 described above in FIGS. 1–6. Mast 104 includes a quadrifilar antenna element 10 formed on a flexible substrate 9, phase network 12, coil spring 6 and flexible cover 7 that are substantially identical as described above in connection with FIGS. 1–5. However, antenna assembly 101 includes an SMB or other RF connector 121 that is secured to the base portion 145 of mast 104. A coaxial jumper cable assembly 147 is assembled with the cover 117 with the upper connector 148 positioned within the threaded protrusion 146 of cover 117. Connector 148 provides a waterproof seal to prevent entry of moisture. The base 103 may be assembled and secured to a motor vehicle, such that the mast assembly 104 can be installed or removed by threading the mast 104 onto the threaded protrusion 146. The SMB connector 121 simultaneously threads onto the connector 148, thereby facilitating installation/removal of mast 104 from base 103. This arrangement permits the mast 104 to be easily removed, for example, for shifting of the motor vehicle.

Base assembly 103 includes a circuit board 122 and electronics case 120. When assembled, the connector 149 of cable 147 is connected to the circuit board 122. Electronics case 120 is similar to electronics case 20 described above. However, electronics case 120 does not include an elastomeric outer shell. Rather, a first gasket 150 is sandwiched between the upper surface 153 of electronics case 120 and inner surface 154 of cover 117 to ensure that the circuit board 122 is sealed off rain, dust, or other such elements. Threaded screws 152 are utilized to secure the electronics case 120 to the cover 117 and compress gasket 150. Electronics case 120 includes a downwardly extending threaded extension 157 that extends through an opening in the surface layer 26 of the motor vehicle when assembled. A threaded nut 155 and sleeve 156 are received on the threaded extension 157, and draw the electronics case 120 and cover 117 downwardly against a second gasket 151 that is thereby sandwiched between the cover 117 and the surface layer 26 of the motor vehicle. Threaded extension 157 includes a passageway for routing of cable 159. Cable assembly 159 includes a connector 160 that is connected to the circuit board 122, with the end portion 161 of cable assembly 159 extending through the threaded nut 155, sleeve 156, gasket 151, and the threaded extension 157.

The present antenna provides a quadrifilar antenna element configured to receive a digital audio signal transmittal from a satellite or other remote location. Advantageously, the antenna mast may be removed for shipping of the vehicle. Further, the flexible mount reduces the likelihood of damage if the antenna strikes, for example, overhead structures in parking garages or the like. The phase network provides a connection to the coaxial cable, with the coaxial cable providing a flexible conductor. The elastomeric cover 7 extends over the coil spring 6 to provide a smooth, uncluttered appearance. The electronics case arrangement and cover provide a waterproof seal for the electronic components, while permitting the antenna to be readily mounted to various vehicles having different surface contours. A base cover having the proper shape for mounting to a particular vehicle may be utilized to mount the mast assembly to a variety of different vehicles. Further, if required the antenna 1 can be easily unscrewed from the base to prevent damage, such as during shipping of the motor vehicle.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. An antenna adapted to be mounted to a mobile vehicle for receiving digital signals from a satellite, comprising:

a base configured to be secured to a vehicle;

an elongated mast constructed of a polymer material and including at least one antenna-forming conductor extending along said mast to receive signals;

a spring member flexibly connecting said elongated mast to said base;

an elastomeric cover extending between said base and said elongated mast and enveloping said spring member; and a flexible conductor connected to said antenna-forming conductor and extending through said elastomeric cover.

2. The antenna set forth in claim 1, wherein:

said at least one antenna-forming conductor comprises four elongated antenna conductors extending around said mast and forming a quadrifilar helical antenna.

3. The antenna set forth in claim 2, wherein:

said mast defines a base end;

each said elongated antenna conductor has an electrical feed point adjacent said base end of said mast; and including:

a phase network electrically connecting said electrical feed points of said electrical conductors to said flexible conductor.

4. The antenna set forth in claim 3, wherein:

said base includes an electronics case having a cavity adapted to receive electronic components therein.

5. The antenna set forth in claim 4, wherein:

said electronics case has an inner shell made of a rigid material forming said cavity, and an outer cover of an elastomeric material enveloping said inner shell and forming a gasket configured to seal said cavity when said electronics case is mounted to a vehicle.

6. The antenna set forth in claim 5, including:

a cover extending over said electronics case, said cover having a perimeter portion thereof adapted to fit closely against an outer surface of a motor vehicle.

7. The antenna set forth in claim 6, including:

a circuit board disposed in said cavity of said electronics case; and wherein:

said spring member is a coil spring; and said flexible conductor is a coaxial cable extending through said coil spring and electrically connected to said circuit board.

8. The antenna set forth in claim 1, wherein:

said mast is constructed of a rigid polymer material.

9. An antenna for receiving digital signals from a satellite, comprising:

a base configured to be secured to a mobile vehicle;

an elongated mast constructed of a dielectric material and having a generally cylindrical outer surface, said mast defining a base end;

four elongated antenna conductors disposed on said outer surface of said elongated mast and forming a quadrifilar helical antenna, each antenna conductor having an electrical feed point adjacent said base end of said elongated mast, said feed points progressively phased by about ninety degrees relative to one another;

a flexible member connecting said elongated mast to said base and biasing said mast into a use position;

a flexible elongated conductor; and a phase network positioned adjacent said base end of said mast and electrically connecting said electrical feed points of said elongated antenna conductors to said flexible cable.

10. The antenna set forth in claim 9, wherein:

said base includes an electronics case having a cavity adapted to receive electronic components therein.

11. The antenna set forth in claim 10, wherein:

said electronics case has an inner shell made of a rigid material forming said cavity, and an outer cover of an elastomeric material enveloping said inner shell and forming a gasket configured to seal said cavity when said electronics case is mounted to a vehicle.

12. The antenna set forth in claim 11, including:

a cover extending over said electronics case, said cover having a perimeter portion thereof adapted to fit closely against an outer surface of a motor vehicle.

13. The antenna set forth in claim 12, including:

a circuit board disposed in said cavity of said electronics case; and wherein:

said flexible member is a coil spring; and said flexible elongated conductor is a coaxial cable extending through said coil spring and electrically connected to said circuit board.

14. The antenna set forth in claim 13, including:

an elastomeric cover extending between said base and said mast and enveloping said coil spring.

15. The antenna set forth in claim 14, wherein:

said mast is constructed of a flexible polymer material.

16. An antenna for mounting on a mobile vehicle for receiving digital signals from a satellite, said antenna comprising:

a base including an electronics case having a cavity adapted to receive electronic components therein, said electronics case having an inner shell made of a rigid material forming said cavity, and an outer cover of an elastomeric material enveloping said inner shell and forming a gasket configured to seal said cavity when said electronics case is mounted to a vehicle;

an elongated mast secured to said base; and at least one elongated antenna conductor extending along said mast to receive signals.

17. The antenna set forth in claim 16, including:

a flexible cable electrically interconnecting said antenna conductor to said base.

18. The antenna set forth in claim 17, wherein:

said at least one antenna conductor comprises four elongated antenna conductors extending around said mast and forming a quadrifilar helical antenna.

19. The antenna set forth in claim 18, wherein:

said mast defines a base end;

each said antenna conductor has an electrical feed point adjacent said base end of said mast; and including:

a phase network electrically connecting said electrical feed points of said antenna conductors to said flexible cable.

20. The antenna set forth in claim 19, including:

a cover extending over said electronics case, said cover having a perimeter portion thereof adapted to fit closely against an outer surface of a motor vehicle.

21. The antenna set forth in claim 16, including:

a spring member interconnecting said base and said mast and biasing said mast into a use position.

22. The antenna set forth in claim 21, including:

said mast is constructed of a rigid polymer material.

* * * * *